US005152033A

United States Patent [19]

White

[11] Patent Number: 5,152,033

[45] Date of Patent: Oct. 6, 1992

[54] TEXTILE APPARATUS/METHOD FOR REDUCING VARIATIONS IN SILVER WEIGHT

[75] Inventor: Homer S. White, Durham, N.C.

[73] Assignee: Myrick-White, Inc., Durham, N.C.

[21] Appl. No.: 729,628

[22] Filed: Jul. 15, 1991

[51] Int. Cl.[5] ..... D01G 15/40; D01H 5/32

[52] U.S. Cl. ..... 19/105; 19/106 R; 19/240

[58] Field of Search ..... 19/105, 98, 106 R, 0.23, 19/236, 239, 240, 150; 364/469, 470

[56] References Cited

U.S. PATENT DOCUMENTS

| | | | |
|---|---|---|---|
| 3,829,751 | 8/1974 | Bottone, Jr. | 19/240 |
| 3,977,046 | 8/1976 | Wise | 19/240 |
| 4,163,927 | 8/1979 | Grice, Jr. | 19/240 |
| 4,393,547 | 7/1983 | Hösel | 19/105 |
| 4,494,204 | 1/1985 | Hösel | 19/105 |
| 4,812,993 | 3/1989 | Konig et al. | 19/239 |
| 4,823,597 | 4/1989 | White | 73/160 |
| 4,982,477 | 1/1991 | Hösel | 19/239 |
| 5,005,267 | 4/1991 | Ackeret | 19/239 |
| 5,018,248 | 5/1991 | Haworth et al. | 19/239 |

FOREIGN PATENT DOCUMENTS

| | | | |
|---|---|---|---|
| 2061338 | 5/1981 | United Kingdom | 19/239 |
| 2081758 | 2/1982 | United Kingdom | 19/105 |

*Primary Examiner*—Werner H. Schroeder
*Assistant Examiner*—Michael A. Neas
*Attorney, Agent, or Firm*—Olive & Olive

[57] ABSTRACT

A method and apparatus for a textile carding machine or drafting machine drawframe having an out-of-round or otherwise imperfect rotating member is based on detecting and analyzing the relative rotative positions of selected of the machines rotating members in relation to the moment to moment weight of the sliver output and developing therefrom a control signal for varying the speed of rotation of a rotative feeding member so as to vary the sliver weight to compensate for such imperfections.

11 Claims, 4 Drawing Sheets

DOFFER & MAIN CYLINDER PATTERNS
DRAWN TO SAME TIME SCALE
(PATTERNS OFFSET BY ANGLES A & B)

COMPUTED CORRECTION FOR DOFFER &
MAIN CYCLINDER PATTERNS
(AS APPLIED TO THE FEED ROLL DRIVE)

TEXTILE APPARATUS/METHOD FOR REDUCING VARIATIONS IN SILVER WEIGHT

FIELD OF INVENTION

This invention relates to a method and apparatus useful in textile carding apparatus and drafting machines for reducing periodic variations in sliver weight caused by imperfections in rotary members of the machine.

BACKGROUND ART

In textile machines, such as carding machines and drawframes, it is frequently observed that periodic defects in the unit sliver weight, i.e. the weight per unit length, are created within the machine and which can be related to imperfections in particular rotating members of the machine such as a roller being out-of-round. Various evenness tests and frequency spectrographs have been previously employed to detect such defects.

Typically, no attempt is made to correct such defects short of replacing the defective component. As one known exception to the practice of replacing the component, a computer controlled sliver weight corrective system has been employed in which the speed of the doffer of a carding machine is adjusted square wave fashion, up and down between two set speeds, once per revolution of the doffer. In this computer control system, the angular position of the doffer is sensed and a program stored profile is built up relating the doffer position to the sliver weight at the time of sensing. This stored profile in the computer then directs the doffer speed to go up or down between the mentioned two set speeds. This system has the disadvantage of being dependent on the square wave form of correction, the further disadvantage of having to respond to the high inertia of the doffer, the disadvantage of being limited to two corrective speeds, and the disadvantage of having to periodically reset the two speeds. Thus, it has been known to attempt to correct for periodic variations in sliver weight by sensing and storing angular positions of a single relatively heavy rotating member, i.e. the doffer, and regulating its speed between two fixed speeds only in accordance with the measured unit weight of the sliver. However, it has not been known or recognized that a more efficient control of sliver weight could be obtained by regulating the speed of the feed roll, sensing the angular positions of plural rotating members and developing a control signal capable of regulating the feed roll speed so that such speed may be any of numerous speeds uniquely suited to the needed sliver weight correction.

An object of the present invention is that of providing a sliver weight corrective system and method which depends on using a computer or programmable controller for regulating the feed roll rather than the doffer and in a manner permitting a relatively wide range of speed changes.

Other objects will become apparent as the description proceeds.

SUMMARY OF INVENTION

The present invention contemplates a sensing device at the output delivery of the machine which gives a signal related to the weight per unit length of the sliver being produced. Other sensing devices are placed on selected rotating members of the machine to sense the moment to moment angular displacement of such members. During the first minute or two of operation of the machine at high speed, a microcomputer, programmable controller or the like is used to relate the moment to moment weight of sliver at the machine output to the moment to moment angular position of each of the rotating members. The preferred method of doing this is to average the readings over a period of time from a number of revolutions of the rotating member into a memory array which is indexed by the angular position of the rotating member. At the end of this period, the information obtained is saved and calculations are made to develop a periodic pattern of speed variations in opposition to the observed output pattern and which is applied as a control signal to the input member of the machine, i.e. the feed roll.

DESCRIPTION OF PREFERRED EMBODIMENTS

Figure 1:
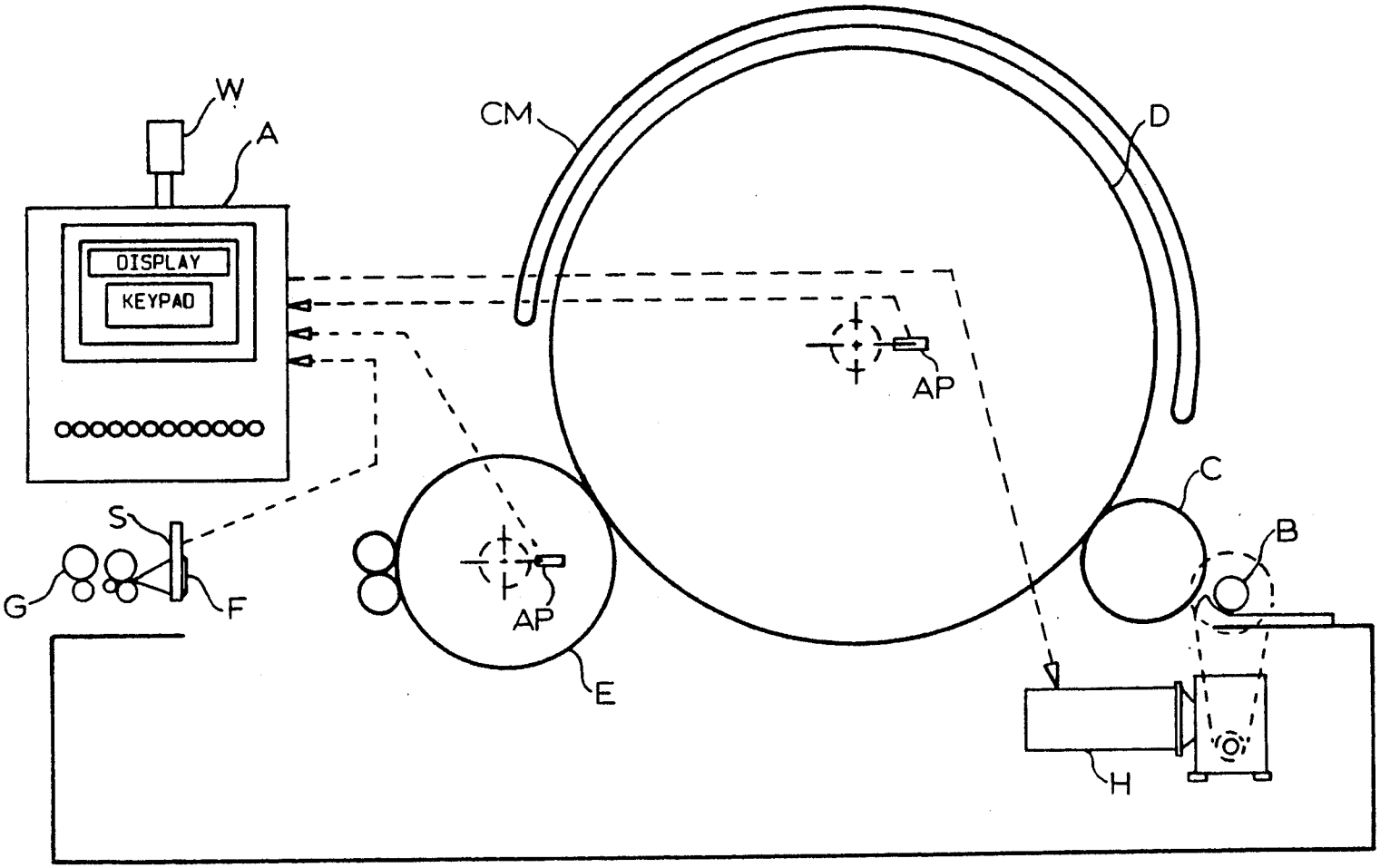
FIG. 1 is a schematic diagram of a typical carding machine equipped with a sliver weight control system according to the invention.

FIG. 1 shows the major rotating members of a typical carding machine CM. In this machine, sensing of the unit sliver weight is done by passing the sliver through a sensor S having a trumpet F mounted on a gage plate which provides an electrical signal proportional to the strain on the gage plate due to the resistance force of the sliver passing through the trumpet. The silver is drawn through the trumpet by calendar, or drafting rolls G. A unit sliver weight sensing device of a type suited to the invention is described in U.S. Pat. No. 4,823,597 the teaching of which is incorporated herein by reference.

The doffer E and the main cylinder D are fitted with devices AP to sense angular position. Devices commonly used for this purpose are optical encoders and gear wheels with proximity detectors. In FIG. 1, gear wheels and proximity sensors are intended to be shown as examples and are shown on the doffer E and the main cylinder D. The input rotating member is the feed roll B which is turned by a variable speed motor H to introduce the feed mat into the carding machine CM. A microcomputer A is used to input information from the sliver unit weight sensor S and the shaft encoders AP, process this information, and finally, output a variable D.C. voltage which is used to determine the speed of the variable speed motor H which drives the feed roll B. Rotating members C, D and E other than the feed roll B are typically driven at fixed rates of speed, once high speed production has been started. A warning signal W such as a blinking red light, buzzer or the like may be employed and wired in circuit to indicate an improper condition.

Figure 2:
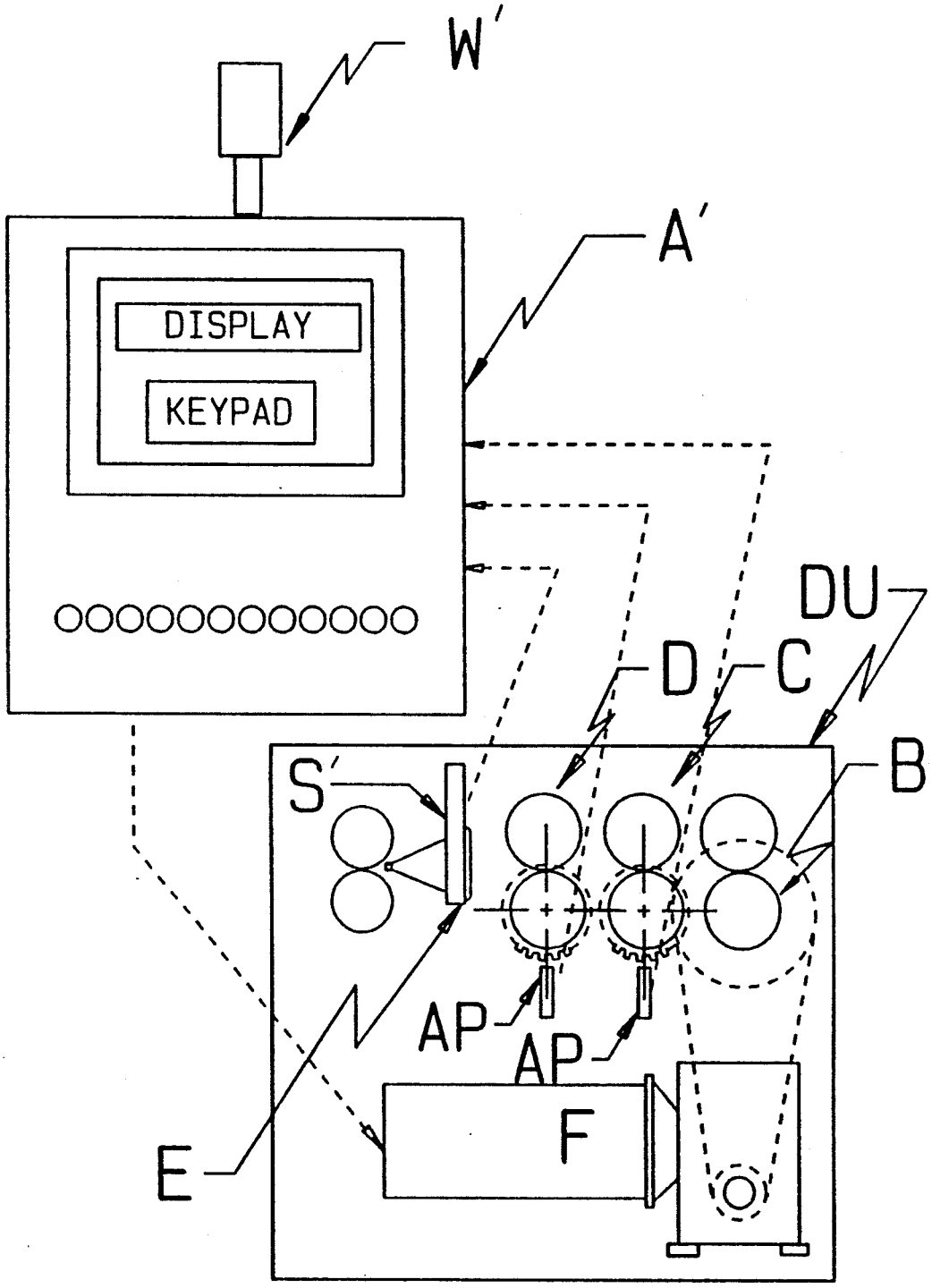
FIG. 2 is a schematic diagram of a typical drafting machine drawframe equipped with a sliver weight control system according to the invention.

FIG. 2, by way of a second embodiment, shows a typical drafting unit DU of a textile drawframe. In this application, the gage plate and trumpet E senses the sliver weight associated with the unit sliver weight sensor S' as previously explained. Shaft encoders or proximity sensors AP are applied to one or more pairs of drafting rolls B, C and D, and a variable speed motor F is connected to one of the input rolls B. The microcomputer A' fitted with warning signal W' acts in much the same way as microcomputer A on the carding machine. In a typical drafting unit, the drafting rolls D are driven at a fixed speed which is higher than the fixed speed at which the drafting rolls C are driven. The input roll B is driven at a variable speed, but in no case exceeding the fixed speed of rolls C.

Figure 3A:
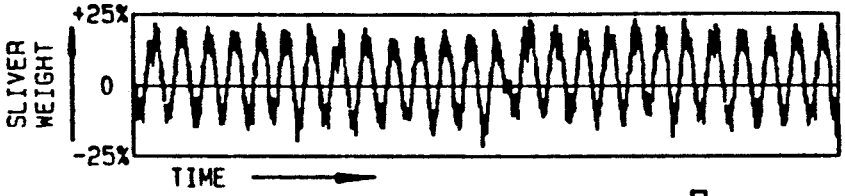
FIG. 3A is a plot of sliver weight evenness produced by a carding machine with an out-of-round doffer.

In FIG. 3A, the weight evenness of sliver produced by a carding machine with an out-of-round doffer is plotted. In this graph, time is plotted on the horizonal axis and sliver weight is plotted on the vertical axis. It is this wide sliver weight variation as illustrated in FIG. 3A which the present invention seeks to avoid.

Figure 3B:
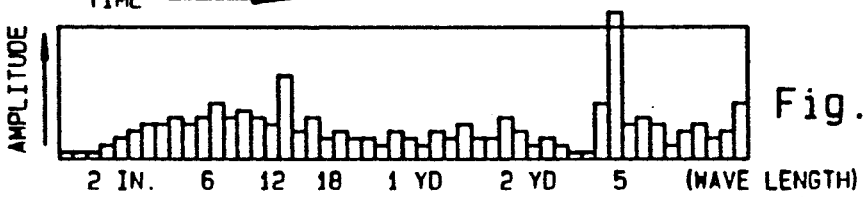
FIG. 3B is a frequency spectrograph of the data seen in FIG. 3A.

FIG. 3B is a frequency spectrograph of the same data as shown in FIG. 3A. The high peak to the left of the 5 yard mark is the major feature of this graph. The regular up and down pattern in the evenness test and the high peak on the spectrograph are evidence of a problem with the doffer roll.

Figure 3C:
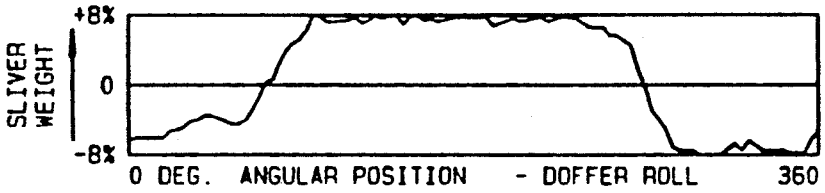
FIG. 3C is a plot of sliver weight at the output of the carding machine referred to in FIG. 3A related to the angular position of the out-of-round doffer averaged over about thirty-two revolutions of the doffer.

FIG. 3C shows the weight pattern at the output related to angular position of the doffer, averaged over about thirty-two revolutions. After running a minute or two at high speed, the information graphed in FIG. 3C is copied to another memory area in the microcomputer which controls the carding machine. At this time,, the average sliver weight for the array is subtracting out from the individual array locations so that each element in the array represents the average deviation from the nominal weight. The microcomputer then multiplies this information by a negative scale factor previously found to produce optimum results for the speed being run and shifts the angular position by a phase angle previously found to give optimum results for the particular speed being run to form a look-up table of corrections to be applied to the speed of the input member of the machine. From this point on, while the machine is run at high speed production, the moment to moment angular position of the doffer is used as an index into the look-up table of corrections in order to produce a pattern of feed roll speed commands which opposes the periodic pattern which would otherwise be generated at the output.

In an alternate method, the saved information from the rotating members remains unchanged except for subtracting out the average of the entire array and corrections are calculated while the machine is running at high speeds as follows:

1. At a particular moment, the angular position of one of the rotating members, e.g. the doffer, is added to a stored number which represents the optimum phase angle shift which in turn is based on the distance between the transfer point to the doffer and the sensing point at the trumpet.

2. If the resulting number is greater than the number of increments of the shaft encoder, then the number is corrected by subtracting the number of increments in one revolution of the encoder.

3 The resulting number is used as an index into the saved memory array for that particular rotating member.

4. The number fetched from the memory array is then multiplied by a scale factor assigned to that rotating shaft.

5. The resulting value is then subtracted from the nominal speed command number for the feed roll.

6 The speed command number is further modified by a similar process for a second rotating member, e.g. the main cylinder.

7. The final speed command number is converted to a D.C. voltage which is used to determine the speed of the feed roll drive motor.

This second method has the advantage of allowing for different gain factors and phase angles to be tried while the machine is operating at high speed. This allows the optimum settings for these values to be determined without taking the machine out of production. Due to averaging effects within the carding machine, it is usually necessary to adjust the gain factor somewhat higher than would otherwise be necessary to compensate for the averaging effect. This is particularly true for tandem cards in which there are two main cylinders, two lickerins, and two doffers, as well as a transfer section.

Figure 4A:
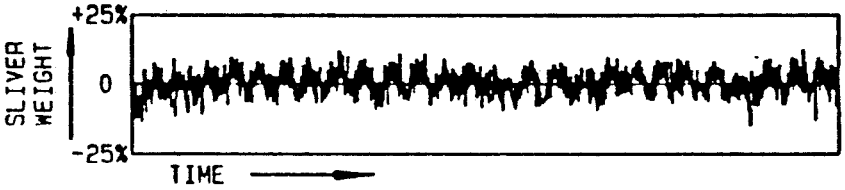
FIG. 4A is a plot of sliver weight evenness produced by the carding machine referred to in FIG. 3A after corrections have been applied utilizing the system of the invention as illustrated in FIG. 1.

FIG. 4A show the results of an evenness test made after the corrections have been applied. The resulting pattern shows little trace of the up and down pattern seen in FIG. 3A.

Figure 4B:
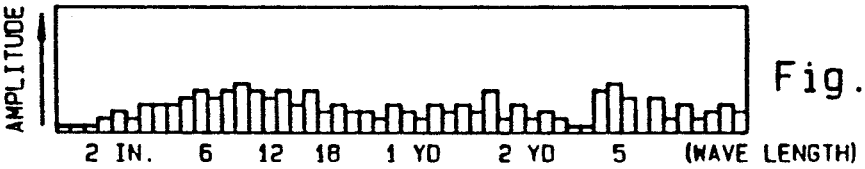
FIG. 4B is a frequency spectrograph of the data seen in FIG. 4A.

The frequency spectrograph seen in FIG. 4B shows the peak at the three yard wavelength to be greatly reduced.

Figure 4C:
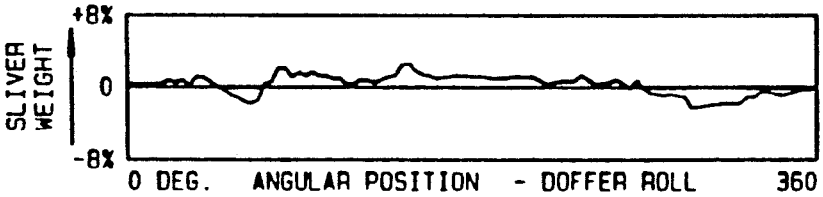
FIG. 4C is a plot of sliver weight at the output of the carding machine referred to in FIG. 3A related to the angular position of the out-of-round doffer averaged over about thirty-two revolutions after corrections have been applied utilizing the system of the invention as illustrated in FIG. 1.

FIG. 4C shows the weight pattern related to the doffer position in FIG. 4C to have been greatly reduced.

Figure 5A:
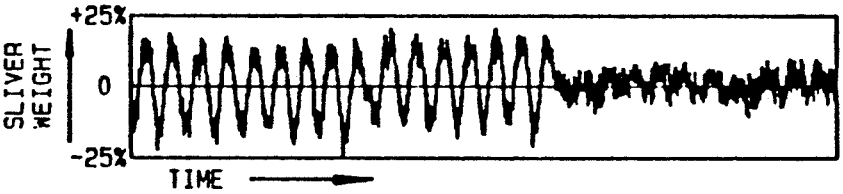
FIG. 5A is a plot of sliver weight evenness produced by the carding machine referred to in FIG. 3A illustrating the effect of the corrections being applied by the invention system of FIG. 1 approximately two minutes after the machine is put into high speed operation.

FIG. 5A shows the effect of the corrections being applied two minutes after the machine has been put into high speed operation.

Figure 5B:
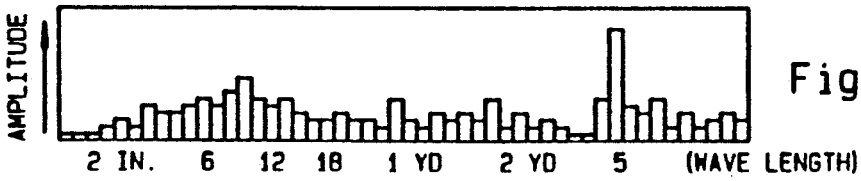
FIG. 5B is a frequency spectrograph of the data seen in FIG. 5A.

FIG. 5B is a spectrograph of the data seen in FIG. 5A.

Figure 6A:
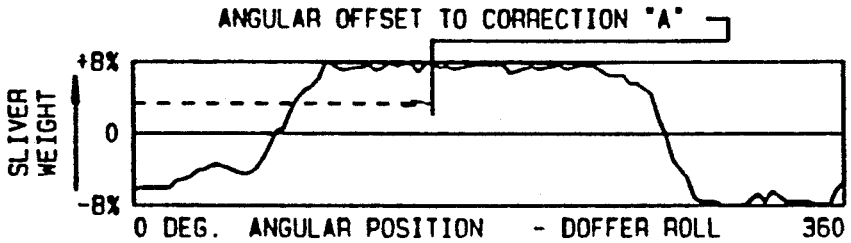
FIG. 6A duplicates the curve seen in FIG. 3C and represents the repeated pattern of sliver weight as related to the angular position of the doffer roll with an illustrative offset phase angle A used for correcting the pattern of sliver variation by adjusting the speed of the feed roll.
Figure 6B:
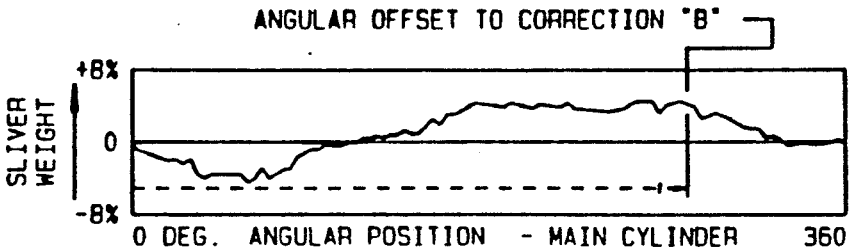
FIG. 6B is similar to FIG. 6A except that it represents the repeated pattern of sliver weight as related to the angular position of the main cylinder with an illustrative offset phase angle B used for correcting the pattern of sliver variation by adjusting the speed of the feed roll.

It should be noted that it is possible to correct for repetitive patterns of more than one rotating member simply by doing the same operations for each rotating member and summing the individual corrections. FIGS. 6A and 6B illustrate corrections based on the doffer roll only whereas FIGS. 6C and 6D illustrate corrections based on combining the doffer roll and main cylinder data.

FIG. 6A represents the repeating pattern of sliver weight as related to the angular position of the doffer roll as previously referred to in FIG. 3C. In this example, when the angular position is zero degrees, the history of sliver weight for that position is about 6% below the average sliver weight. For the purpose of correcting this pattern by adjusting the speed of the feed roll, it is necessary to find by calculation or by trial and error, an offset phase angle "A" which is shown in FIG. 6A. Adding this offset A to the present angular position of the doffer roll accommodates for transit time of the material between the feed roll and the doffer, and between the doffer and the sensing device at the output of the card.

FIG. 6B is similar to FIG. 6A except that FIG. 6B relates the repeating pattern of sliver weight as related to the angular position of the main cylinder. An angular offset "B" is shown which forms a similar function to angle "A" for the doffer roll.

Figure 6C:
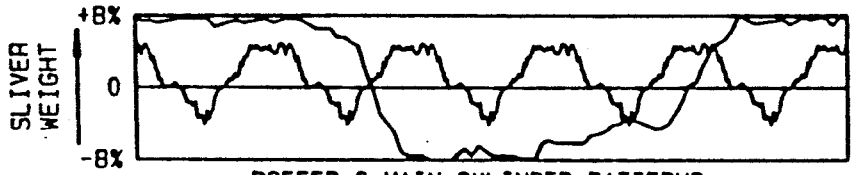
FIG. 6C shows the patterns for the doffer roll and the main cylinder plotted together to the same time scale. In this example the main cylinder is assumed to be rotating about five times faster than the doffer roll and the patterns are assumed to be offset by illustrative offset angles A and B.
Figure 6D:
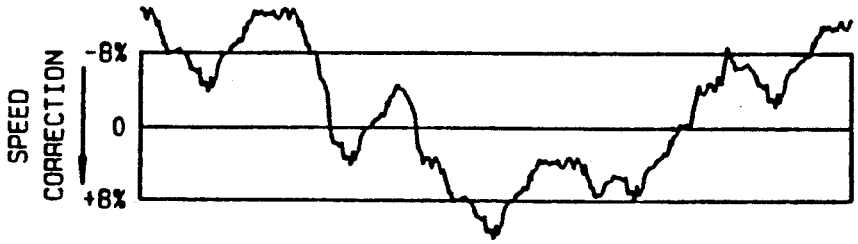
FIG. 6D illustrates the patterns of FIG. 6C combined by applying scale factors to each pattern.

FIG. 6C shows the patterns for the doffer roll and the main cylinder plotted together to the same time scale. In this example, the main cylinder is rotating about five times faster than the doffer roll so that five complete main cylinder patterns take place in the same time that one pattern of the doffer roll is completed. The patterns have been offset by angles "A" and "B" respectively.

In FIG. 6D, the patterns in FIG. 6C have been combined by applying scale factors to each pattern (in this example, the scale factor is unity), and summing the two patterns. This results in a plot of the moment-to-moment corrections to the speed of the feed roll. Since the correction of the speed of the feed roll is in opposition to the repeated patterns, the vertical scale of this digram is inverted as compared with other figures.

In summary it can be seen that all of the objective's have been achieved and that there have been described a dramatically improved system and method for correcting for repetitive variations in unit sliver weight. Various details may be changed without departing from the scope of the invention, the foregoing description being for the purpose of illustration only.

What is claimed is:

1. An improved system for correcting periodic variations in the unit weight of a sliver attributable to imperfections in certain of the rotary means of a textile machine having plural rotary means for continuously producing a sliver of a specified unit weight including input rotary means for feeding to the machine the material needed to produce such sliver and output rotary means for discharging such sliver from the machine, having means for continuously receiving the produced sliver from the output rotary means and measuring its unit weight, and having means for varying the speed of the input rotary means in order to vary the unit weight, said system comprising:

(a) means for sensing moment to moment angular displacement of selected of the rotary means and developing electrical data representative of such displacement;

(b) programmable control means:

(i) operative for storing and analyzing:

(aa) said data representative of said angular displacement; and (bb) electrical data derived from the means for measuring the unit weight and indicative of the moment to moment value thereof; and (ii) developing in response to storing and analyzing said data, an electrical control signal representative of a needed input feed speed correction to correct a periodic variation in said unit weight;

(c) means for changing the speed of the input rotary means; and (d) means for applying said control signal to the means for changing the speed of the input rotary means to vary the speed of the input rotary means to correct said variation.

2. In a textile machine, an improved system for correcting periodic variations in the unit weight as claimed in claim 1 wherein said machine comprises a carding machine and said rotary means comprise rotary components thereof.

3. In a textile machine, an improved system for correcting periodic variations in the unit weight as claimed in claim 1 wherein said machine comprises a drafting machine and said rotary means comprise rotary components thereof.

4. In a textile machine, an improved system for correcting periodic variations in the unit weight as claimed in claim 1 wherein said programmable control means comprises a computer.

5. In a textile machine, an improved system for correcting periodic variations in the unit weight as claimed in claim 1 wherein said programmable control means includes software operative in a short initial period of operation of said machine to obtain information relating said output unit sliver weight to said angular position of selected rotating members of the textile machine, to thereafter calculate look-up tables of corrective actions and then to output speed commands to said input rotary means of the machine to make the corrections.

6. A method for correcting periodic variations in the unit weight of a sliver attributable to imperfections in certain of the rotary means of a machine having plural rotary means for continuously producing a sliver of a specified unit weight including input rotary means for feeding the machine the material needed to produce such sliver and output rotary means for discharging such sliver from the machine, having means for continuously receiving the produced sliver from the output rotary means, having means for measuring such sliver and continuously producing an electrical signal representative of its unit weight and having electrical control means for varying the speed of the input rotary means in order to vary the unit weight, comprising the steps of:

(a) sensing the moment to moment angular displacement of selected of the rotary means and developing electrical data representative of such displacement;

(b) continuously transferring the electrical data representative of such displacement together with the electrical signal representative of the measured unit weight to a programmed controller programmed to process such data and signal and develop therefrom a control signal representative of needed input feed speed correction to correct a periodic variation of said unit weight attributable to an imperfection in said rotary means;

(c) applying said control signal to said input rotary means to correct said unit weight to correct said variation to achieve said specified unit weight; and (d) changing the speed of said input rotary means in response to said control signal.

7. A method for reducing repetitive variations in sliver weight produced by a textile machine having rotating members for producing the sliver; comprising:

(a) locating a weighing device capable of weighing the unit sliver weight at the output of the machine and using the device to develop a signal related to the weight per unit length of the output sliver;

(b) locating one or more angular position sensing devices on rotating members of the machine and using such angular sensing devices to indicate the moment to moment angular position of the rotating members;

(c) relating the moment to moment weight of the sliver produced by the machine to the moment to moment angular position of selected of the rotating members in the machine;

(d) calculating corrective speed commands based on the information gained in step (c);

(e) producing speed commands sent to the input member of the machine with corrections based on step (d); and (f) changing the speed of said input member in response to said speed commands.

8. The method of claim 7 in which the gathering of correction information, the calculation of the corrective action, and the output of the speed commands with the corrections are done with a computer having software.

9. The method of claim 7 in which the gathering of correction information, the calculation of the corrective action, and the output of the speed commands with the corrections are done with a programmable controller having software.

10. The method of claim 8 in which the software for the computer is operative in a short initial period of operation, to obtain information relating output sliver weight to angular position of rotating members of the textile machine, to thereafter calculate look-up tables of corrective actions, and then to output speed commands to an input rotating member of the machine to make the corrections.

11. The method of claim 9 in which the software for the programmable controller is operative in a short initial period of operation to obtain information relating output sliver weight to angular position of rotating members of the textile machine, to thereafter calculate look-up tables of corrective actions, and then to output speed commands to an input rotating member of the machine to make the corrections.

* * * * *

MYWI 5004P

UNITED STATES PATENT AND TRADEMARK OFFICE

CERTIFICATE OF CORRECTION

PATENT NO. : 5,152,033

DATED : October 6, 1992

INVENTOR(S) : Homer S. White

It is certified that error appears in the above-identified patent and that said Letters Patent is hereby corrected as shown below:

On the title page, in the title, "SILVER" should read --SLIVER--.
(PTO error)

Column 1, in the title, "SILVER" should read --SLIVER--.
(PTO error)

Column 4, line 3, delete second comma (,) appearing after "At this time,".
(PTO error)

Signed and Sealed this

Twenty-first Day of September, 1993

Bruce Lehman

*Attest:*

BRUCE LEHMAN

*Attesting Officer*

*Commissioner of Patents and Trademarks*